US009188053B2

(12) United States Patent
Abihana

(10) Patent No.: US 9,188,053 B2
(45) Date of Patent: Nov. 17, 2015

(54) METHODS AND DEVICES FOR CONTROLLING A VEHICLE COOLANT PUMP

(71) Applicant: FORD GLOBAL TECHNOLOGIES, LLC, Dearborn, MI (US)

(72) Inventor: Osama Abihana, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 14/016,094

(22) Filed: Aug. 31, 2013

(65) Prior Publication Data

US 2015/0066263 A1 Mar. 5, 2015

(51) Int. Cl.
*B60L 11/00* (2006.01)
*F01P 7/16* (2006.01)

(52) U.S. Cl.
CPC ..... *F01P 7/164* (2013.01); *F01P 7/167* (2013.01); *Y10S 903/903* (2013.01)

(58) Field of Classification Search
CPC ..... F01P 2005/105; F01P 7/048; F01P 7/164; F01P 7/167; F02M 25/0731; F02M 25/0728; Y10S 903/903
USPC ..... 701/22, 36, 101, 29.1, 33.4, 102; 123/41.02, 41.44, 41.1, 563; 180/65.28; 903/903
See application file for complete search history.

(56) References Cited

U.S. PATENT DOCUMENTS

| | | | | |
|---|---|---|---|---|
| 7,272,487 | B2 | 9/2007 | Christen et al. | |
| 7,735,744 | B2 | 6/2010 | Eisenhour | |
| 7,836,862 | B2 | 11/2010 | Shi et al. | |
| 2007/0261682 | A1 * | 11/2007 | Smith | 123/563 |
| 2011/0107983 | A1 * | 5/2011 | Magro | 123/41.1 |
| 2011/0214627 | A1 * | 9/2011 | Nishikawa et al. | 123/41.02 |
| 2014/0261254 | A1 * | 9/2014 | Gonze et al. | 123/41.08 |

* cited by examiner

*Primary Examiner* — Gertrude Arthur Jeanglaude
(74) *Attorney, Agent, or Firm* — David B. Kelley; Brooks Kushman P.C.

(57) ABSTRACT

Methods and devices for controlling a vehicle electric coolant pump include operating the coolant pump at a speed to provide a desired coolant flow based on a temperature difference between an engine coolant inlet temperature and an engine coolant outlet temperature. A hybrid vehicle having an engine and an electric water pump includes a controller that controls water pump speed to provide coolant flow based on a differential temperature between an engine coolant inlet and an engine coolant outlet. Pump speed may also be controlled based on engine speed and load. Control of an electric water pump based on temperature difference, engine speed, and load may result in faster engine warm up and reduce pump power consumption.

5 Claims, 4 Drawing Sheets

300

| | | | | | | | | | | | | | |
|---|---|---|---|---|---|---|---|---|---|---|---|---|---|
| RPM | | 1000 | 1000 | 1001 | 1001 | 1001 | 1001 | 1001 | 2001 | 1999 | 2000 | 2000 | 2000 |
| EECLOAD | | 0.25 | 0.25 | 0.25 | 0.5 | 0.5 | 0.5 | 0.5 | 0.69 | 0.685 | 0.684 | 0.682 | 0.682 |
| COOLANT IN | DEG F | 192.5 | 182.3 | 194.7 | 193.8 | 188.6 | 182.5 | 195 | 200.3 | 193.1 | 188.7 | 182.6 | 182.6 |
| COOLANT OUT | DEG F | 199.4 | 200.3 | 199.1 | 199.8 | 200.2 | 199.5 | 200.3 | 200.3 | 200.3 | 199.9 | 200.4 | 200.4 |
| H2OFLOW | CFM | 0.718 | 0.319 | 1.279 | 1.278 | 0.713 | 0.48 | 2.57 | 2.064 | 1.406 | 0.804 | 0.804 | 0.804 |
| H2OFLOW | GPM | 5.371013 | 2.386286 | 9.567584 | 9.560103 | 5.33361 | 3.590649 | 19.22493 | 15.43979 | 10.51761 | 6.014337 | 6.014337 | 6.014337 |
| DELTA T | | 6.9 | 18 | 4.4 | 6 | 11.6 | 17 | 5.3 | 7.2 | 11.2 | 17.8 | 17.8 | 17.8 |

312 314 310 316

FIG. 3

420 430 440 410 400

| ENGINE SPEED | LOAD | ΔT(C°) | FLOW (LPM) |
|---|---|---|---|
| 1500 | 0.25 | 9 | 0 |
| 1800 | 0.3 | 9 | 4 |
| 2500 | 0.4 | 8 | 28 |
| 3500 | 0.35 | 7 | 50 |
| 4000 | 0.55 | 5 | 85 |
| 5000 | 0.6 | 5 | 100 |
| 6000 | 0.7 | 5 | 116 |

FIG. 4

METHODS AND DEVICES FOR CONTROLLING A VEHICLE COOLANT PUMP

TECHNICAL FIELD

This disclosure relates generally to controlling a vehicle electric water/coolant pump based on at least a temperature differential to improve efficiency.

BACKGROUND

Vehicles generally include a cooling system that circulates a cooling fluid to regulate the temperature of various vehicle components. The cooling fluid is generally a water-based fluid that is mixed with a modifier, such as ethylene glycol to lower the freezing temperature and raise the boiling temperature. Although referred to as a cooling fluid, water, or coolant, the fluid may be used to heat or cool vehicle components or the vehicle cabin to a desired operating temperature. As used throughout this disclosure, references to coolant should be understood to include any type of cooling fluid used to raise or lower the operating temperature of one or more vehicle components. The coolant is generally circulated through a cooling circuit by one or more associated pumps. For vehicles having an internal combustion engine, including hybrid vehicles, a coolant or water pump may be mechanically operated by rotation of the engine crankshaft. Because of their reliance on engine operation, mechanically actuated coolant pumps operate only when the engine operates. A mechanically actuated water pump may be replaced by, or supplemented by, an electrically actuated water pump in various applications, such as hybrid vehicles. Similarly, electric vehicles that do not include an internal combustion engine may include a water pump to provide heating/cooling of various vehicle components, such as a traction battery and/or vehicle cabin. Electrically actuated water pumps provide greater control flexibility as they can be operated based on various vehicle and ambient operating conditions.

Vehicle cooling circuits may include various components to regulate the temperature of the coolant. For example, the cooling circuit may include a thermostat that limits or prevents coolant circulation through a heat exchanger or radiator to reduce the time needed for the coolant to attain a desired operating temperature. Coolant flow may also be directed through a heat exchanger or heater core in response to a request for cabin heating or battery conditioning, for example.

For applications that include an internal combustion engine and an electric water pump, the pump operation may be based on engine temperature and engine load, for example. While suitable for many applications, this can lead to more coolant flow than needed under some operating conditions.

SUMMARY

Embodiments of the disclosure include a vehicle having an engine including a coolant inlet and a coolant outlet, a water pump connected to the engine and configured to pump fluid through a coolant circuit, and at least one controller in communication with the water pump and configured to control the water pump based at least on a temperature difference between the engine coolant inlet and the engine coolant outlet.

Embodiments of the disclosure include a method for cooling an engine by controlling an electrically operated water pump in response to at least a temperature difference between an engine coolant inlet and an engine coolant outlet.

In one embodiment, a vehicle includes a coolant pump and a controller configured to control the coolant flow rate of the coolant pump based on a predefined temperature difference between a coolant temperature at an engine coolant inlet and a coolant temperature at an engine coolant outlet. The coolant pump speed is controlled to provide the desired coolant flow rate. The desired coolant flow rate may also be based on engine speed and load. In one embodiment, a desired coolant pump flow rate is calculated using current engine coolant inlet and outlet temperatures, engine speed, and engine load using an empirically determined regression equation.

Embodiments according to the present disclosure provide a number of advantages. For example, the present disclosure provides a system and method for reducing power consumption of an electric water pump by recognizing the relationship between the coolant flow rate, engine speed and load, and engine coolant inlet/outlet temperature difference to control coolant flow rate and optimize pump operation to maintain desired operating temperature ranges. Controlling operation of an electric water pump based on at least a temperature difference between an engine coolant inlet and outlet improves efficiency relative to operation based only on engine speed by better matching of coolant flow rate to predicted thermal loading of the cooling system. Operation of an electric water pump according to various embodiments takes advantage of the fact that a cold engine can tolerate a larger temperature difference between inlet and outlet temperatures than a hot engine. Control of the coolant flow rate by controlling the water/coolant pump speed based on the inlet/outlet temperature difference facilitates faster engine warm-up and cabin heating while reducing overall pump energy consumption.

The above advantages and other advantages and features of the present disclosure will be readily apparent from the following detailed description of the preferred embodiments when taken in connection with the accompanying drawings.

BRIEF DESCRIPTION OF THE DRAWINGS

FIG. 3 is an exemplary table of empirical data that may be used to calculate a coolant pump flow rate for use in controlling the pump to reduce energy consumption according to embodiments of the disclosure; and FIG. 4 is an exemplary table showing various coolant flow rates calculated from a set of empirical data, such as those of FIG. 3 for use in a vehicle according to embodiments of the disclosure.

DETAILED DESCRIPTION

Figure 1:
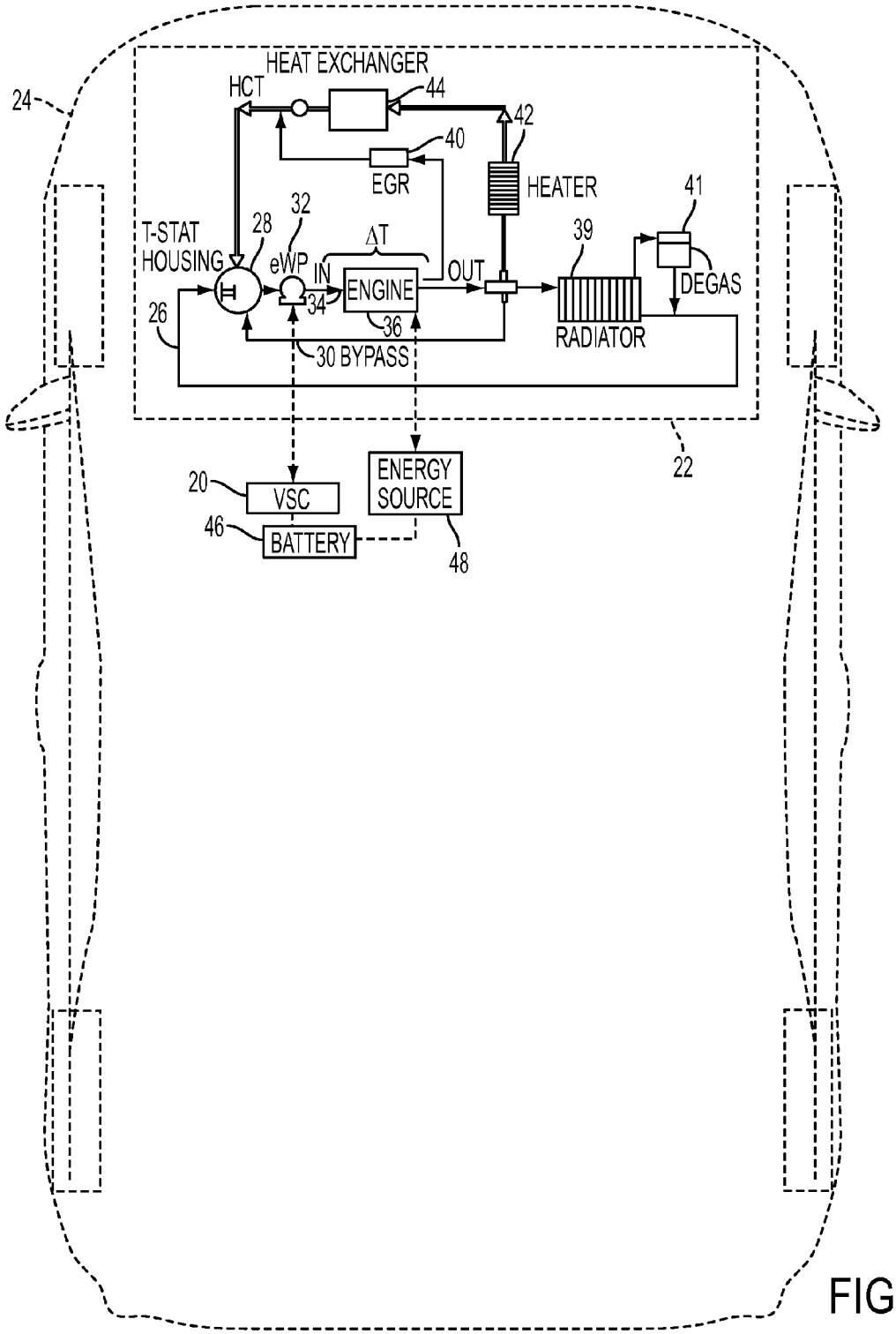
FIG. 1 is a schematic diagram of a vehicle of one embodiment of the disclosure having an engine coolant system with an electric water pump controlled to reduce energy consumption.

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the teachings of the disclosure. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations. As previously described, the term "engine coolant" or "coolant" or "water" or "cooling fluid" refers to a fluid cooling agent for heat transfer between one or more vehicle components and ambient and may commonly be referred to as anti-freeze or coolant. It is typically made up of propylene glycol and ethylene glycol diluted with water, but may be implemented by various other types of cooling fluid depending on the particular application as generally understood by those of ordinary skill in the art.

Various embodiments may include a controller or control circuitry, either of which may include a microprocessor or central processing unit (CPU) in communication with various types of non-transitory computer readable storage devices or media. Non-transitory computer readable storage devices or media may include volatile and nonvolatile storage in read-only memory (ROM) and random-access memory (RAM), for example. Computer-readable storage devices or media may be implemented using any of a number of memory devices such as PROMs (programmable read-only memory), EPROMs (electrically PROM), EEPROMs (electrically erasable PROM), flash memory, or any other electric, electronic, magnetic, optical, or combination memory devices capable of storing data, some of which represent executable instructions, used by the controller or processing circuitry. The embodiments of the present disclosure generally provide for a plurality of circuits or other electrical devices. All references to the circuits and other electrical devices and the functionality provided by each, are not intended to be limited to encompassing only what is explicitly illustrated and described. While particular labels may be assigned to the various circuits or other electrical devices disclosed, such labels are not intended to limit the scope of operation for the controllers, circuits, and/or other electrical devices. Such circuits and other electrical devices may be combined with each other and/or separated in any manner based on the particular type of electrical implementation that is desired.

Control logic or functions performed by a processor, processing circuitry, or other control circuitry or controller may be represented by flow charts or similar diagrams in one or more figures. These figures provide representative control strategies and/or logic that may be implemented using one or more processing strategies such as event-driven, interrupt-driven, multi-tasking, multi-threading, and the like. As such, various steps or functions illustrated may be performed in the sequence illustrated, in parallel, or in some cases omitted. Similarly, steps or functions may be performed by a single controller or multiple controllers in communication over a network, such as a controller area network (CAN). Although not always explicitly illustrated, one of ordinary skill in the art will recognize that one or more of the illustrated steps or functions may be repeatedly performed depending upon the particular processing strategy being used. Similarly, the order of processing is not necessarily required to achieve the features and advantages described, but is provided for ease of illustration and description. The control logic may be implemented primarily in software executed by a microprocessor-based controller. Of course, the control logic may be implemented in software, hardware, or a combination of software and hardware in one or more controllers or processors depending upon the particular application. When implemented in software, the control logic may be provided in one or more computer-readable storage devices or media having stored data representing code or instructions executed by a computer.

One embodiment of a method or device for controlling coolant flow rate in a vehicle having an electric coolant pump is illustrated in the block diagram of FIG. 1. Vehicle cooling system 22 of a vehicle 24 may include a coolant line 26, a thermostat 28, and an electric water pump (eWP) or coolant pump 32. Thermostat 28 and the electric coolant pump 32 are connected by coolant line 26, which leads the output of the thermostat 28 and the electric coolant pump 32 to a coolant inlet 34 of engine 36. The coolant line 26 also connects a coolant outlet 38 of engine 36 to a radiator 39, which may include an associated overflow/degas tank 41. A coolant bypass line 30 may be connected between the coolant outlet 38 and the radiator 39. The coolant bypass line 30 may bypass the radiator 39 and lead coolant back to the thermostat 28, to the electric coolant pump 32, and then to engine 36. Vehicle 24 may also include a heater core 42 to provide heat to the vehicle cabin and a heat exchanger 44 that may be associated with an exhaust gas recirculation (EGR) system 40.

As illustrated in FIG. 1, vehicle 24 may include one or more controllers to control various vehicle systems and subsystems. In FIG. 1, a vehicle system controller (VSC) 20 controls operation of various vehicle systems and may communicate with one or more other controllers. For example, vehicle 24 may include controllers or modules such as a traction control module, anti-lock brake system module, powertrain control module, engine controller, etc. The controllers generally include a microprocessor in communication with non-transitory computer readable storage media or devices, including volatile, persistent, and/or permanent memory devices such as random access memory (RAM) or keep-alive memory (KAM), for example. The computer-readable storage media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the microprocessor to directly or indirectly control coolant flow rate by operating and/or controlling speed of coolant pump 32. Various controllers may communicate with each other using a standard communication protocol, such as the controller area network (CAN) protocol, for example. One or more controllers may be in direct or indirect communication with associated sensors that measure or detect various vehicle and/or ambient operating conditions, such as engine coolant inlet temperature 34 and engine coolant outlet temperature 38, for example.

When engine 36 is running, VSC 20 calculates or otherwise determines a desired coolant flow rate to maintain operating temperature within a predetermined range and controls electric coolant pump 32 operating speed to provide the desired coolant flow rate to the engine cooling circuit. In contrast to various prior art strategies that determine coolant flow rate and/or coolant pump speed based primarily on engine speed and load, embodiments of the present disclosure determine coolant flow rate based on a desired engine coolant inlet/outlet differential temperature, which may be based on current engine coolant temperature until the engine coolant temperature reaches an associated threshold, and then set to a minimum value. As illustrated in FIG. 1, electric coolant pump 32 circulates coolant through coolant circuit 26 and thermostat 28 to engine 36. Initially, the coolant may be circulated through the coolant bypass line 30 to bypass radiator 39 until the coolant reaches a temperature sufficient to open thermostat 28. For example, thermostat 28 may be constructed so that it begins to open when the engine coolant temperature reaches 82 degrees Celsius. Bypassing of radiator 39 allows the engine 38 to reach a desired operating temperature more quickly for reduced emissions, while also making cabin heating available more quickly.

When thermostat 28 opens, the coolant flows through radiator 39 to provide additional cooling and maintain the engine operating temperature within a desired range. As explained in greater detail below, VSC 20 may also increase or decrease speed of electric coolant pump 32 to modify the coolant flow rate to maintain the engine operating temperature within a desired range. The desired coolant flow rate and associated coolant pump operating speed may be determined based on a difference between engine coolant inlet temperature 34 and engine coolant outlet temperature 38 in addition to current engine speed and load. Engine coolant inlet temperature may be measured at or near the location where coolant enters the engine or engine cooling jacket with the location depending on the particular application and implementation. The inlet coolant temperature may be measured at various locations upstream of the actual engine inlet. Similarly, the engine coolant outlet temperature may be measured at various locations downstream of the actual engine outlet depending on the particular application and implementation.

The electric coolant pump 32 may be connected to a traction battery 46. Engine 36 may be connected to a power source 48, such as a fuel system or fuel cell, and may also be connected to traction battery 46 via a motor/generator. Operation of electric coolant pump 32 at higher coolant flow rates and corresponding higher speeds requires more energy from battery 46 and/or fuel source 48. As such, it is generally desirable to operate electric coolant pump 32 only when needed to maintain the engine or other vehicle components within a desired operating temperature range. Similarly, it is generally desirable to optimize electric coolant pump operation and operating speed so that the coolant flow rate does not exceed the rate required to maintain the engine operating temperature within a desired range, which may result in longer warm-up time in addition to wasted energy and lower system efficiency.

Figure 2:
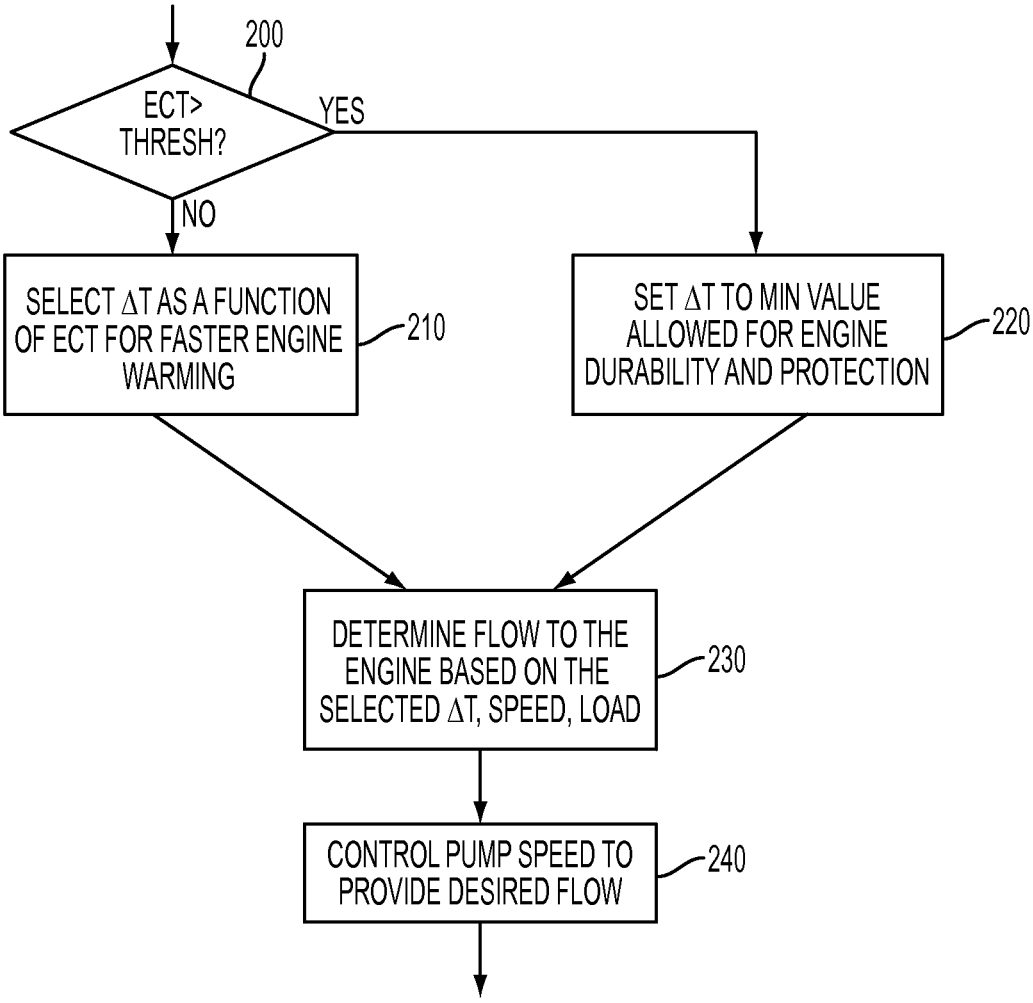
FIG. 2 is a simplified flow chart illustrating operation of a representative device or method for controlling a vehicle electric water pump of various embodiments of the disclosure.

FIG. 2 is a flow chart illustrating operation of a device or method for controlling an electric coolant pump of a hybrid vehicle according to various embodiments of the present disclosure. In block 200, engine coolant temperature (ECT) is compared to an associated threshold. If ECT is below the threshold, a desired temperature differential or delta temperature between the engine coolant inlet temperature and the engine coolant outlet temperature may be selected or determined as a function of the current engine coolant temperature as represented by block 210. In one embodiment, the desired delta temperature may be selected or determined from a look-up table indexed by ECT. This facilitates faster engine warming as a larger temperature difference can be accommodated when the engine is cold without concern of the engine temperature exceeding the desired maximum operating temperature than when the engine is hot. If the current engine coolant temperature exceeds the threshold as determined at block 200, then the desired temperature differential or delta temperature is set to a minimum value as represented by block 220.

A desired coolant flow rate is determined as represented by block 230 based on the determined or selected delta inlet-outlet temperature for the current engine speed and load. In one embodiment, the desired flow rate is determined using a regression equation having empirically determined constants for a particular application as described in greater detail with reference to FIGS. 3 and 4. The pump speed is then controlled as represented by block 240 to deliver the desired coolant flow rate to the engine to maintain the selected inlet-outlet temperature differential. Use of a varying desired temperature differential based on current engine coolant temperature in addition to current engine speed and load results in more efficient energy use by the electric coolant pump because the pump operating time and speeds are reduced relative to prior strategies based primarily on engine speed and load.

Embodiments of the present disclosure automatically control electric coolant pump operation and speed to improve overall system efficiency. In one embodiment, a regression equation having empirically determined constants is used to determine a flow rate to achieve a desired inlet-outlet coolant temperature differential for the current engine speed, load, and coolant temperature according to:

$$\text{Flow Rate}=\alpha+(\beta\times\text{Engine speed})+(\rho\times\text{Load})+(\alpha\times\Delta T)$$

where $\alpha$, $\beta$, $\rho$, and $\sigma$ are empirically determined constants and $\Delta T$ is the desired inlet-outlet coolant temperature differential.

Referring now to FIG. 3, a table of empirical results 300 is shown to establish a relationship between coolant flow rate (H20FLOW), engine speed (RPM), load (EECLOAD), and differential temperature ($\Delta T$) between coolant inlet temperature (COOLANT IN) and coolant outlet temperature (COOLANT OUT) for a representative hybrid vehicle application. FIG. 3 illustrates some representative data provided by dynamometer testing of an engine for flow rates 310 at various engine speeds 312, engine loads 314, and differential temperatures 316. Actual data used in determining the constants based on a regression analysis includes data for substantially more operating conditions than illustrated in FIG. 3 with engine speeds ranging from 1000 rpm to 6,000 rpm, loads varied from 0.25 to 1, and $\Delta T$ varied from 4 to 10 degrees Celsius, for example. A regression equation may then be obtained with representative values for the previously described constants as follows:

$$\text{Electric Coolant Pump Flow}=48.5+(0.018\times\text{EngineSpeed})+(39.6\times\text{Load})+(-9.52\times\Delta T)$$

Of course, the data may be used to determine various other types of equations depending on the particular application and implementation. In an exemplary implementation, when a vehicle is traveling at a certain engine speed and with a certain load, the vehicle system controller (VSC) may continuously calculate the desired electric coolant pump flow rate based on the empirically determined equation and adjust the electric coolant pump flow to the calculated flow rate by increasing or decreasing the pump speed to maintain a predefined engine coolant temperature difference across the engine coolant inlet and outlet. The selected $\Delta T$ balances achieving a faster engine warm up and preventing the engine from exceeding a maximum desired operating temperature. An exemplary predetermined minimum $\Delta T$ may be set at 5 degrees Celsius for a hot engine with the selected or desired $\Delta T$ varying from a maximum of 10 degrees Celsius for a cold engine to the minimum $\Delta T$ as a function of current engine coolant temperature (ECT). A hot engine may be predefined as an engine having a temperature above 82 degrees Celsius, for example. The $\Delta T$ for a cold engine may be larger than a warm engine to minimize flow for faster engine warm up and to allow for faster cabin heating. As the engine warms up and ECT increases, the selected or desired ΔT decreases until it reaches the minimum value to prevent the engine temperature from exceeding a maximum desired operating temperature.

FIG. 4 is an exemplary table 400 showing the relationship between the empirically determined flow rates 410 at associated engine speeds 420 and loads 430 to maintain a selected or desired ΔT 440. As illustrated by the representative values of FIG. 4, for engine operation where the engine is cold and is running at an engine speed of 1500 rpm with a desired ΔT maintained at 9 degrees Celsius, the VSC sets the pump flow rate to zero, which means the vehicle does not need to expend energy to operate the pump. This, in turn, allows the vehicle to save fuel or electricity consumption, and also allows the engine to warm up quickly. When the engine is allowed to warm up quickly, the vehicle cabin can be warmed up quickly when desired as well. As the engine speed 420 and load 430 increase, such as from 1800 rpm to 3500 rpm, and 0.25 to 0.35, respectively, the selected or desired ΔT changes from 9 to 7 degrees Celsius. In response, the VSC increases the pump flow rate from 4 liters per minute (LPM) to 50 LPM to attain or maintain the desired ΔT of 7 degrees Celsius. Similarly, as the engine speed 420 increases from 4000 rpm to 6000 rpm, the VSC increases the pump flow rate to 116 LPM by increasing the pump speed to keep the ΔT at 5 degrees Celsius. It can be realized that the vehicle cooling systems and methods described can efficiently set the pump flow rate such that energy consumption is minimized while at the same time maintaining the engine operating temperature within a desired operating range.

As demonstrated by the representative embodiments described above, the present disclosure provides a system and method for reducing power consumption of an electric water pump by recognizing the relationship between the coolant flow rate, engine speed and load, and engine coolant inlet/outlet temperature difference to control coolant flow rate and optimize pump operation to maintain desired operating temperature ranges. Controlling operation of an electric water pump based on at least a temperature difference between an engine coolant inlet and outlet improves efficiency relative to operation based only on engine speed by better matching of coolant flow rate to predicted thermal loading of the cooling system. Operation of an electric water pump according to various embodiments takes advantage of the fact that a cold engine can tolerate a larger temperature difference between inlet and outlet temperatures than a hot engine. Control of the coolant flow rate by controlling the water/coolant pump speed based on the inlet/outlet temperature difference facilitates faster engine warm-up and cabin heating while reducing overall pump energy consumption.

While the best mode has been described in detail, those familiar with the art will recognize various alternative designs and embodiments within the scope of the following claims. While various embodiments may have been described as providing advantages or being preferred over other embodiments with respect to one or more desired characteristics, as one skilled in the art is aware, one or more characteristics may be compromised to achieve desired system attributes, which depend on the specific application and implementation. These attributes include, but are not limited to: cost, strength, durability, life cycle cost, marketability, appearance, packaging, size, serviceability, weight, manufacturability, ease of assembly, etc. The embodiments discussed herein that are described as less desirable than other embodiments or prior art implementations with respect to one or more characteristics are not outside the scope of the disclosure and may be desirable for particular applications.

What is claimed is:

1. A vehicle comprising:

an engine including a coolant inlet and a coolant outlet;

an electric pump connected to the engine and configured to flow coolant; and a controller in communication with the pump and configured to vary pump speed based on a selected difference between coolant inlet and outlet temperature, wherein the selected difference varies in response to current coolant temperature when the current coolant temperature is below an associated threshold.

2. The vehicle of claim 1 wherein the controller is configured to control the pump speed based on a minimum differential temperature between the coolant inlet and the coolant outlet when the current coolant temperature exceeds the associated threshold.

3. A method for controlling a vehicle having an electric coolant pump, comprising:

controlling electric coolant pump speed based on a desired coolant flow rate using an empirically determined regression equation for representative engine speeds and loads based on current engine speed, load, and temperature difference between engine coolant inlet temperature and engine coolant outlet temperature.

4. A method for controlling an electric coolant pump of a hybrid vehicle having a fraction battery and a controller configured for:

operating the electric coolant pump at a pump speed based on, engine speed and load, and a target temperature difference between an engine coolant inlet and outlet;

wherein the target temperature difference is based on current engine coolant temperature if the current temperature is below a threshold and a predetermined minimum value otherwise.

5. The method of claim 4 wherein the controller is configured to operate the electric coolant pump based on a desired coolant flow calculated according to an equation of the form:

$$\text{Desired Coolant Flow}=\alpha+(\beta\times\text{Engine speed})+(\rho\times\text{Load})+(\sigma\times\Delta T)$$

where α, β, ρ, and σ are constants empirically determined from a regression analysis and ΔT is the temperature difference between the engine coolant inlet temperature and the engine coolant outlet temperature.

* * * * *